United States Patent [19]

Handa

[11] 4,305,594

[45] Dec. 15, 1981

[54] SEALING DEVICE FOR A ROTARY REGENERATIVE HEAT EXCHANGER

[75] Inventor: Noritoshi Handa, Yokosuka, Japan

[73] Assignee: Nissan Motor Co., Ltd., Yokohama, Japan

[21] Appl. No.: 129,255

[22] Filed: Mar. 11, 1980

[30] Foreign Application Priority Data

Mar. 13, 1979 [JP] Japan ..... 54-31180[U]

[51] Int. Cl.[3] ..... F28D 19/00; F16J 15/34

[52] U.S. Cl. ..... 277/81 R; 277/92; 277/228; 165/9

[58] Field of Search ..... 165/9; 277/81 R, 83, 277/92, 95, 96, 96.2, 227, 228, 235 A, DIG. 6

[56] References Cited

U.S. PATENT DOCUMENTS

| | | | |
|---|---|---|---|
| 3,692,097 | 9/1972 | Penny | 277/96.2 X |
| 3,743,008 | 7/1973 | Zeek et al. | 277/235 A X |
| 3,913,926 | 10/1975 | Rao | 165/9 X |
| 3,931,852 | 1/1976 | Rao | 277/81 R X |
| 4,134,446 | 1/1979 | Okano et al. | 165/9 |
| 4,183,539 | 1/1980 | French et al. | 277/81 R X |

FOREIGN PATENT DOCUMENTS

| | | | |
|---|---|---|---|
| 2734966 | 2/1979 | Fed. Rep. of Germany | 165/9 |
| 1383928 | 2/1975 | United Kingdom | 165/9 |

*Primary Examiner*—Robert S. Ward, Jr.

[57] ABSTRACT

A sealing device for a rotary regenerative heat exchanger has a rotary regenerator whose one end slidably contacts with the rotary regenerator, a slide member, and a seal plate urged to the other side of the slide member by pressure difference across the plate. The seal plate is mounted on the housing, while a supporting member is secured with the slide member to contact with intermediate portion of the seal plate. When the slide member is worn, the supporting member is separated from the seal plate to decrease effective rigidity of the seal plate to maintain contact of the seal plate with the slide member.

3 Claims, 9 Drawing Figures

SEALING DEVICE FOR A ROTARY REGENERATIVE HEAT EXCHANGER

BACKGROUND OF THE INVENTION

The present invention relates to a sealing device for a rotary regenerative heat exchanger, and more particularly to a sealing device for a rotary regenerative heat exchanger including a heat exchanger housing, a rotary regenerator accommodated in the housing, a slide member slidably contacting with one side surface of the rotary regenerator, and a thin flat seal plate, one end of which engages with the other side surface of the slide member and the other end of which is secured with housing of the heat exchanger.

A conventional rotary regenerative heat exchanger for regenerating gas turbine engine is shown in FIGS. 1 and 2, which includes a compressor 1, a compressor turbine 2, and a power turbine 5.

A working fluid passage 3 between the compressor 1 and the compressor turbine 2 is inserted with a burner 4. The passage 3 upstream of the burner 4 is formed adjacent with an exhaust passage 6 of the power turbine 5, in a housing 7 of a rotary regenerative heat exchanger. A rotary regenerator 8 communicates with both passages 3 and 6 and is rotatably mounted in the housing 7. A sealing device 9 is mounted around the exhaust passage 6 of the power turbine 5, as shown in FIG. 2. A pressure chamber 10 is formed around the rotary regenerator 8 and communicates with the passage 3. Pressure in the pressure chamber 10 is utilized to urge the sealing device 9 and prevent leakage across the sealing device 9.

Conventional construction of such a sealing device 9 is shown in FIG. 3. One side surface of a sliding member 11 consisting essentially of carbon is slidably engaged with side surface of the rotary regenerator 8. A holder 12 holds the other surface of the sliding member 11 while the opposite surface 12*a* of the holder 12 is secured with smaller end of conical seal plate 13. Larger end of the seal plate 13 is engaged with a seal surface 7*a* of the housing 7. A supporting member 14 is laid on the housing side surface of the seal plate 13, and is secured to the holder 12. Pressure difference between the pressure chamber 10 and the exhaust passage 6 elastically deforms and urges the seal plate 13 on the seal surface 7*a* of the housing 7. The supporting member 14 is to support the seal plate 13 from excessive deformation.

Other conventional sealing device of the rotary regenerative heat exchanger is shown in FIG. 4. Same reference numeral designates corresponding part or portion shown in FIG. 3. The seal plate 13 shown in FIG. 4 is tapered in opposite direction to that shown in FIG. 3. The seal plate 13 and the support 14 are secured to the housing 7, while the outer end of the seal plate 13 is urged against the surface 12*a* of the holder 12.

In the conventional sealing devices shown in FIGS. 1 to 4, when the sliding member 11 or the main housing side sliding member 15 is worn, distance between the seat surface 12*a* of the holder 12 which holds the seal plate 13 and the seal surface 7*a* of the housing 7 increases gradually. To adapt for the change of the distance and to maintain the desired sealing property, deformation of the seal plate 13 must be increased. Thus, for example, a plurality of slits 16 are formed through the peripheral portion of the seal plate 13 as shown in FIG. 5. Such slits tend to invite gas leakage which is another disadvantage. When the number of the slits are decreased, cracks 17 shown in FIG. 5 may be formed by the deformation stress applied to the seal plate 13 so that the desired sealing property may be impaired.

To mitigate such disadvantages, another known sealing device shown in FIG. 6 utilizes flat seal plate 13 and flat supporting member 14 laid on the seal plate 13, which are secured to the housing 7 to eliminate the slits 16 shown in FIG. 5. As the supporting member 14 limits deformation of the seal plate 13, follow-up performance of the seal plate 13 is impaired. Thus, when the sliding members 11 and 15 are worn, sealing property between the seat surface 12*a* of the holder 12 and the outer edge of the seal plate is impaired to form a clearance therebetween. Consequently, starting performance of the gas turbine engine is impaired due to the leakage of gas through the clearance.

SUMMARY OF THE INVENTION

The object of the present invention is to mitigate the above-mentioned disadvantages and to provide a sealing device for a rotary regenerative heat exchanger of the type mentioned-above, having an improved followability without impairing the sealing property.

The sealing device for a rotary regenerative heat exchanger, according to the present invention, is characterized by a supporting member integrally secured to the slide member or to a holder which holds the slide member, the supporting member being engageable with intermediate portion of the seal plate.

Conventionally, such a supporting member has been secured with the housing or the holder with the seal plate. According to the present invention, the seal plate is mounted to the housing while the supporting member is secured to the slide member or the holder thereof. By supporting intermediate portion of the seal plate in operation, desired rigidity of the seal plate under pressure difference across the seal plate is maintained. When the distance between the holder and the housing is increased, the support is separated from the seal plate and the rigidity of the seal plate is decreased, so that the seal plate can easily be deformed by the pressure difference, to maintain contact of the seal plate with the slide member. Thus, followability of the seal plate as well as reliability and durability of the sealing device are improved.

Preferably, the supporting member is formed as a portion of the slide member or the holder.

Preferably, the supporting member is formed by at least one elastic member, e.g., silicone rubber or spring, secured to the slide member or the holder.

The elastic supporting member ensures deformation property of the seal plate to be continuous, which is desirable for severe operating conditions.

The present invention will now be described with reference to some preferred embodiments shown in the drawing.

DESCRIPTION OF PREFERRED EMBODIMENTS

Figure 1:
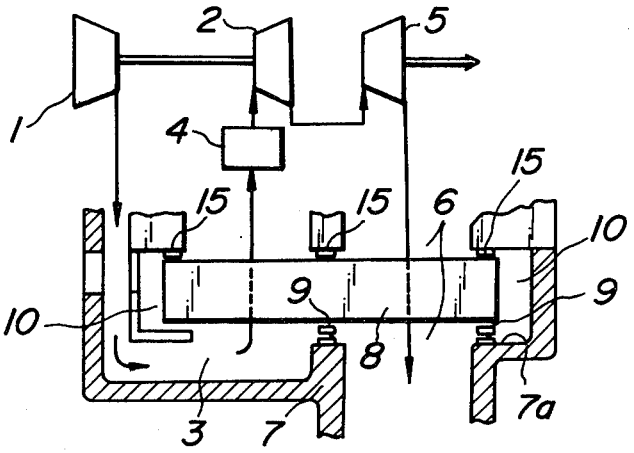
FIG. 1 PRIOR ART
FIG. 1 is a schematic sectional view of a rotary regenerative heat exchanger.
Figure 2:
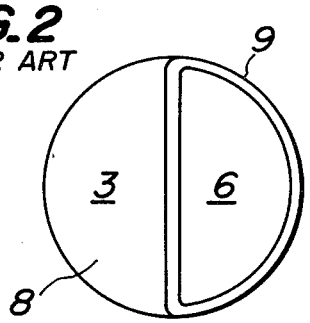
FIG. 2 PRIOR ART
FIG. 2 is a schematic view showing the sealing device.
Figure 3:
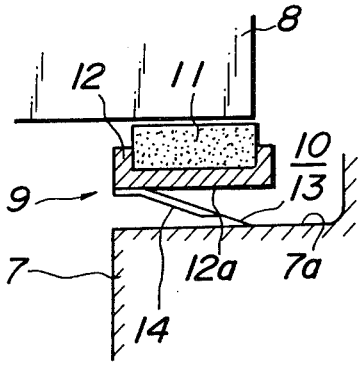
FIG. 3 PRIOR ART
FIG. 3 is an enlarged sectional view of a portion of a conventional sealing device.
Figure 4:
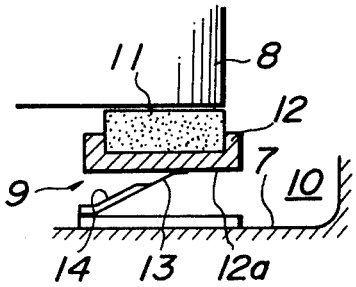
FIG. 4 PRIOR ART
FIG. 4 is a sectional view of another conventional sealing device.
Figure 5:
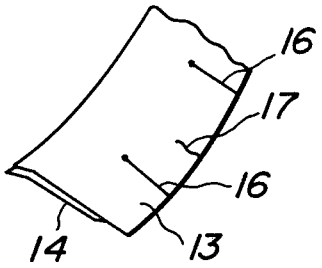
FIG. 5 PRIOR ART
FIG. 5 is a fragmentary perspective view of a portion of seal plate shown in FIG. 3.
Figure 6:
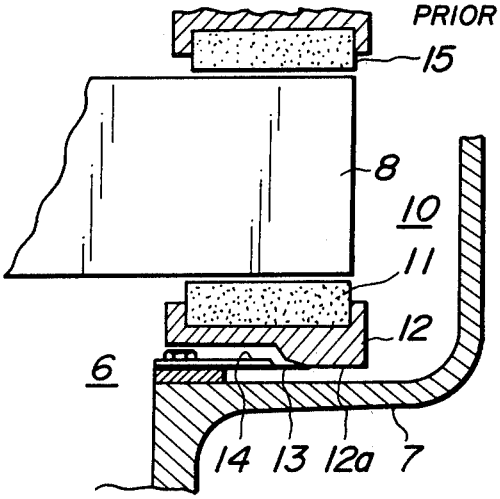
FIG. 6 PRIOR ART
FIG. 6 is a sectional view of still another conventional sealing device.
Figure 7:
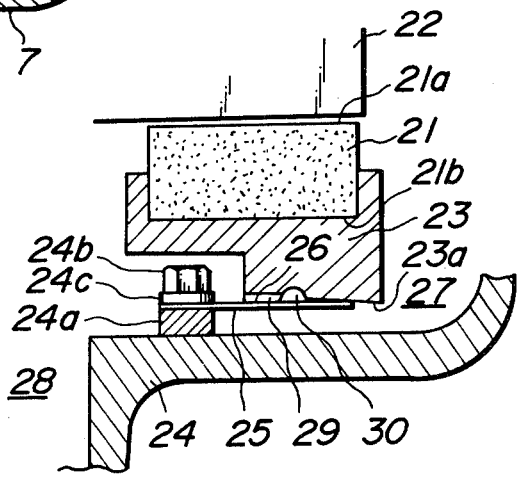
FIG. 7 is a sectional view of a sealing device according to a first embodiment of the present invention.

An embodiment of a sealing device for a rotary regenerative heat exchanger, according to the present invention, is shown in FIG. 7. A sliding member 21 of rectangular cross-section is formed of a porous material consisting essentially of carbon. The member 21 has a sliding surface 21*a* which slidably contacts with side surface of a rotary regenerator 22. The sliding member 21 is secured on the other surface 21*b* to a holder 23 which reinforces and holds the sliding member 21.

A seal plate 25 in the form of a thin flat plate is secured with a housing 24 of the exchanger through a mounting member 24*a* by bolts 24*b* and washers 24*c*. Outer peripheral end portion of the seal plate 25 is engaged with a seat surface 23*a* of the holder 23. According to the present invention, a supporting member 26 is integrally formed with the holder 23 and is engaged with middle portion of the seal plate 25. As the seal plate 25 contacts the supporting member 26, the seal plate 25 is not excessively deformed even when there is a pressure difference between an outer and an inner passages 27 and 28. On the seat surface 23*a* of the holder 23, a recess 30 may be formed radially outwardly of the supporting member 26, which is communicated with the inner passage 28 through a plurality of radial grooves 29 so as to regulate urging force between the seal surface 23*a* and the seal plate 25.

When the sliding member 21 is worn and the distance between the seat surface 23*a* of the holder 23 and the opposite surface of the housing 24 is increased, the supporting member 26 separates from the seal plate 25. Thus, the lever length of the seal plate 25 is increased so that the seal plate 25 easily deforms and outer edge portion of the seal plate 25 is urged on the seat surface 23*a* of the holder 23 by the pressure difference across the seal plate 25.

In other words, when the supporting member 26 is moved with the seat surface 23*a* which contacts with the outer edge portion of the seal plate 25, effective rigidity of the seal plate 25 is decreased and the followability of the seal plate 25 is improved as compared with the conventional sealing devices. The seal plate 25 may normally contact with the supporting member 26; however, in view of machining or assembling error, slight clearance may preferably be formed between the seal plate 25 and the support 26 at least in the assembled or inoperative state, to improve contact between the seal surface 23*a* and the seal plate 25 in operation.

Figure 8:
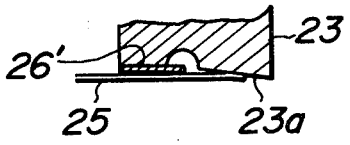
FIG. 8 is a sectional view of a sealing device according to a second embodiment of the present invention.
Figure 9:
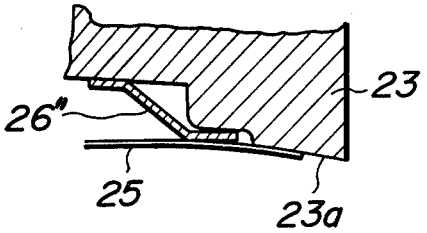
FIG. 9 is a sectional view of a sealing device according to a third embodiment of the present invention.

In the embodiment shown in FIG. 7, the supporting member 26 is formed as a portion of the holder 23. Other embodiments of the supporting member are shown in FIGS. 8 and 9. In FIG. 8, a supporting member 26' is formed of suitable elastic material, e.g., silicone rubber, and is secured to the holder 23. In FIG. 9, a plurality of supporting members 26'' are formed by plate springs, each secured to the holder 23. By the elasticity of the supporting members 26' and 26'', the seal plate 25 can be deformed smoothly, without sudden change of rigidity. Although not shown in the drawing, the seal plate may engage with the outer side surface 21*b* of the sliding member 21 to provide similar effects. When the distance between the fixed end of the seal plate 25 and the supporting member 26 is large, auxiliary supporting members may be additionally provided at the fixed end of the seal plate 25 to regulate rigidity of the seal plate.

It will be appreciated that, according to the sealing device of the present invention, the seal surface which engages with seal end of the seal plate 25 moves integrally with the supporting member 26 which supports the seal plate 25 so that the supporting member does not prevent the seal plate 25 from engaging with the seal surface 23*a* of the holder 23 even when the sliding member is worn excessively. As the supporting member 26 protects the seal plate from deformation as in the conventional arrangement, and also regulates the rigidity of the seal plate, according to the present invention, followable range of the seal plate is increased, and reliability and durability of the seal plate is improved.

What is claimed is:

1. A sealng device for a rotary regenerative heat exchanger comprising a heat exchanger housing, a rotary regenerator positioned in the housing, a slide member slidably contacting one side surface of the rotary regenerator, a holder for said slide member, a thin flat sealing plate one end of which engages with another side surface of the slide member, and the other end of which is secured to the housing, a supporting member integrally secured to said holder, said supporting member being engageable with and at an intermediate portion of said sealing plate.

2. A sealing device according to claim 1, wherein said supporting member is resilient.

3. A sealing device according to claim 2, wherein said supporting member comprises silicone rubber.

* * * * *